United States Patent [19]

Barankin et al.

[11] Patent Number: 4,700,167

[45] Date of Patent: Oct. 13, 1987

[54] BOBBIN CONSTRUCTION WITH STRAIN RELIEF

[75] Inventors: Froim Barankin, Toronto; Migirdic Kendiroglu, Thornhill; Beyrouth B. Micheletti, Oakville, all of Canada

[73] Assignee: General Signal Corporation, Stamford, Conn.

[21] Appl. No.: 901,685

[22] Filed: Aug. 29, 1986

[51] Int. Cl.[4] ..... H01F 15/10

[52] U.S. Cl. ..... 336/192; 174/135; 336/208; 439/457

[58] Field of Search ..... 336/198, 208, 192; 174/135; 339/105

[56] References Cited

U.S. PATENT DOCUMENTS

| | | | |
|---|---|---|---|
| 2,787,769 | 4/1957 | Hill et al. | 336/192 |
| 3,259,864 | 7/1966 | Marzolf et al. | 336/192 |
| 3,315,198 | 4/1967 | Biesma et al. | 336/192 |
| 3,585,450 | 6/1971 | Lane | 336/192 X |
| 3,742,412 | 6/1973 | Lakin | 336/192 |
| 3,745,500 | 7/1973 | Simon | 336/192 |
| 3,792,398 | 2/1974 | Norlin et al. | 336/198 X |
| 4,363,014 | 12/1982 | Leach et al. | 336/192 X |
| 4,427,962 | 1/1984 | Liberman | 336/208 X |

*Primary Examiner*—Thomas J. Kozma

*Attorney, Agent, or Firm*—Ronald Reichman; Robert Hubbard; John Ohlandt

[57] ABSTRACT

A bobbin construction that features a unique termination connection means or assembly at one end of the bobbin, including closely spaced apart recesses, one of the recesses being adapted to receive the crimped portion resulting from joining together a lead and one end of the reactor coil, the other recess having the lead threaded therethrough; consequently, the termination arrangement has excellent strain relief, that is, an assembler can pick up the unit by the leads without damage to the termination connection.

1 Claim, 4 Drawing Figures

FIG.1
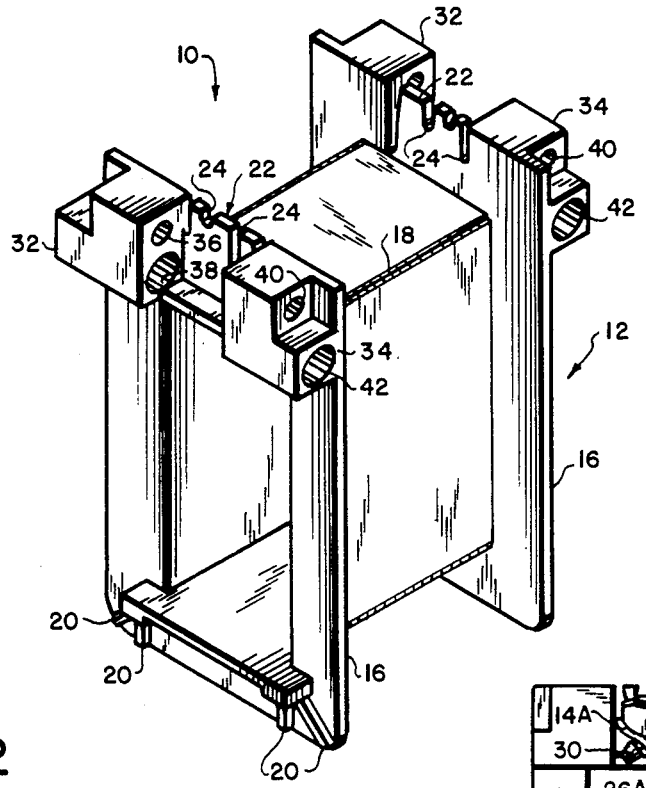
FIG.2
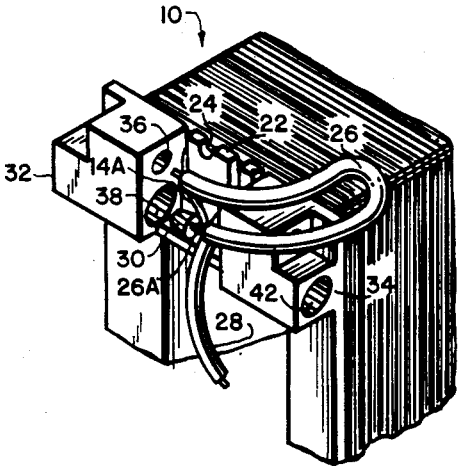
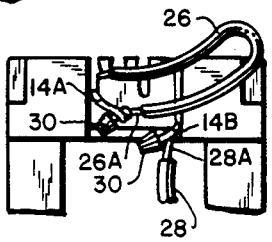
FIG.3
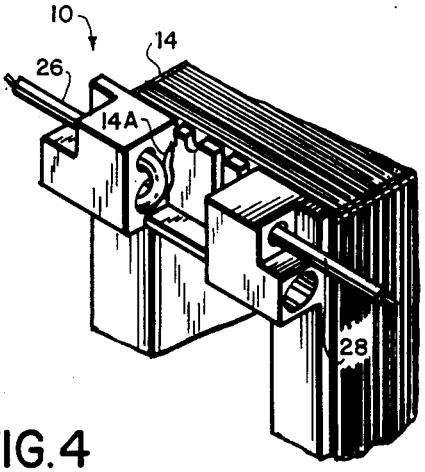
FIG.4

BOBBIN CONSTRUCTION WITH STRAIN RELIEF

BACKGROUND OF THE INVENTION

This invention pertains to a bobbin construction for a reactor ballast and, in particular, to a coil termination connection on such a bobbin, and to a method of assembling same.

It has been the practice in the field of bobbin construction to provide a termination connection arrangement in the fabrication of bobbins and the like by crimping a lead to the end of the coil which has been wound on the bobbin. Thereafter, the crimped assembly of the coil end and the lead is embedded in a potting compound such as an epoxy. The difficulty here is that it is impossible completely to encapsulate the assembly safely in a small cavity or channel, and with good quality on a consistent basis.

Accordingly, the problem as presented in bobbin construction as above described is how to make a reliable and safe coil termination connection.

It is therefore the principal object of the present invention to enable a firm mechanical connection in the crimp assembly described, while providing good insulation to promote safety of the user.

A further object is to avoid the need to encapsulate the crimped coiled end and lead, and to insure a low cost termination connection means.

SUMMARY OF THE INVENTION

The present invention fulfills and implements the objects enumerated above by a bobbin construction having as its primary feature a termination connection means at one end of the bobbin, said means comprising at least one pair of spaced apart pairs of recesses; a first lead adapted to be connected to one end of the winding defining the coil, and the second lead adapted to be connected to the other end of the winding; means for crimping together the first lead with one end of the winding, and the second lead with the other end, the resulting crimped portion being retained in a respective one recess of the pairs of recesses, the first and second leads extending through the respective other recess of the pairs of recesses.

Another aspect of the present invention relates to the method of assembling the coil termination connection involving the steps of providing the required recesses on the bobbin and performing the crimping operation of the two leads with their respective ends of the coil winding and placing those crimped portions in the recesses adapted to receive them and threading the individual leads through the other recess in each of the respective pairs of recesses so that strain relief is provided in the assembly, whereby the bobbin can be picked up by the leads without damage to the coil termination connection. Thus a clear advantage of strain relief is afforded by the construction and method of the present invention.

Other and further objects, advantages and features of the present invention will be understood by reference to the following specification in conjunction with the annexed drawing, wherein like parts have been given like numbers.

BRIEF DESCRIPTION OF DRAWING

FIG. 1 is a perspective view of a bobbin adapted to be used in connection with a reactor ballast, before any coil windings have been wound on the bobbin.

FIG. 2 is a fragmentary perspective, particularly illustrating the termination connection assembly in accordance with the present invention at the point in the construction where the coil winding or windings have been wound and the crimping operation has been carried out whereby each end of the winding has been connected to a suitable lead.

FIG. 3 is a front elevation view, similar to FIG. 2.

FIG. 4 is another perspective view, at a later stage of the assembly, illustrating the fact that the crimped portions have been received in the recesses provided for the purpose, and also that the leads have been drawn through the other recess in each of the respective pairs of recesses provided.

DESCRIPTION OF PREFERRED EMBODIMENT

Referring now to the figures of the drawing, and particularly for the moment to FIG. 1, there will be seen the particular bobbin construction in accordance with the preferred embodiment. The entire construction is designated 10 and is made up of a bobbin 12 on which a coil 14 (FIG. 2) is wound, the bobbin having a generally annular shape including a flange 16 at either side of the bobbin in order to retain the coil winding 14.

It will be noted that a series of grooves 18 are provided at the outer peripheral surface of the annular portion to aid in appropriate spacing of the turns of the winding as the coil is being wound. Reinforcing ribs 20 are provided at the bottom of the individual flanges 16 in order to strengthen the whole structure.

A transversely extending web 22 is seen at the upper end of each of the flanges 16, and these are provided with a series of slots 24 for the purpose of permitting the end portions of the coil winding to be appropriately threaded and retained in furtherance of the assembly of a termination connection to be described.

Referring now to FIGS. 2, 3 and 4 of the drawing, there are depicted several stages in the assembly of the bobbin construction, and particularly in assembling the coil termination connection of the present invention. Thus, there will be seen a pair of leads 26 and 28 which serve to connect the bobbin construction to the other elements of a reactor ballast. One end 26A of lead 26 is crimped together with the upper or finishing end of the coil winding, such end being designated 14A. The other lead, that is lead 28, has its one end 28A crimped or connected together to the starting end 14B of the coil winding.

After crimping together of the first lead 26 with the one end of the winding and the second lead 28 with the other end of the winding, the resulting, respective crimped portions are covered with a conventional cap or crimp device 30 such as that manufactured by the Amp Corporation.

Termination blocks 32 and 34 are disposed at opposite ends of the web 22 on each of the flanges, and each is provided with closely spaced apart recesses 36 and 38 for block 32, and 40 and 42 for block 34.

It will be understood that the resulting crimped portions already described are placed in the lower one of the recesses provided in the respective blocks 32 and 34. For example, the crimped portion constituted by coil winding end 14A and lead end 26A is placed in recess 38 and the lead 26 is drawn or threaded through the upper recess 36 of that pair. Likewise, the other crimped portion is placed into the recess 42 and the corresponding lead 28 is threaded through recess 40.

Accordingly it will be appreciated that complete strain relief is provided with such arrangement inasmuch as the bobbin 12 can be picked up by the aforesaid leads, that is leads 26 and 28, without damage to the coil termination connection described.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

We claim:

1. A bobbin construction comprising:

a coil, and a bobbin on which said coil is wound, said bobbin having a generally annular shape including a flange on either side to retain said coil;

a termination connection means at one end of at least one of the bobbin flanges, said means comprising transversely spaced termination blocks integrally formed as part of said flanges, each block containing a pair of horizontally extending recesses spaced one above the other; said termination connection means further comprising a web extending between said termination blocks, a series of slots of varying depth being spaced along the top of the web;

a first lead connected to one end of the winding defining said coil, and a second lead connected to the other end of said winding; the end portions of each of the coil windings being selectively retained in said slots;

means for crimping together said first lead with said one end of said coil winding and said second lead with said other end, the resulting crimped portions being retained in the respective one recess of the pairs of recesses and the first and second leads being looped back and extended through the respective other recess of the pairs of recesses, whereby strain relief is effectuated such that the total assembly can be picked up by said leads.

* * * * *